US008922121B2

(12) United States Patent
Willemsen et al.

(10) Patent No.: US 8,922,121 B2
(45) Date of Patent: Dec. 30, 2014

(54) LIGHTING SYSTEM, ELECTRODE DEVICE AND LIGHT SOURCE

(75) Inventors: Oscar Hendrikus Willemsen, Eindhoven (NL); Stefan Marcus Verbrugh, Eindhoven (NL); Mark Verhoeven, Deurne (NL); Cornelis Gerardus Maria De Haas, Eindhoven (NL); Menno Van Baardwijk, Eindhoven (NL); Siebe Tjerk De Zwart, Eindhoven (NL); Egbert Lenderink, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 1075 days.

(21) Appl. No.: 12/866,301

(22) PCT Filed: Feb. 6, 2009

(86) PCT No.: PCT/IB2009/050494

§ 371 (c)(1),
(2), (4) Date: Aug. 5, 2010

(87) PCT Pub. No.: WO2009/101559

PCT Pub. Date: Aug. 20, 2009

(65) Prior Publication Data

US 2010/0327744 A1 Dec. 30, 2010

(30) Foreign Application Priority Data

Feb. 14, 2008 (EP) ..... 08151444

(51) Int. Cl.

| | |
|---|---|
| ***H01J 13/46*** | (2006.01) |
| ***F21S 2/00*** | (2006.01) |
| ***F21V 21/096*** | (2006.01) |
| ***F21V 21/002*** | (2006.01) |
| *F21V 21/35* | (2006.01) |
| *H01R 4/24* | (2006.01) |
| *F21V 23/06* | (2006.01) |

(52) U.S. Cl.

CPC ..... *F21V 21/002* (2013.01); *F21V 21/35* (2013.01); *H01R 4/2404* (2013.01); *F21S 2/00* (2013.01); *F21V 21/096* (2013.01); *F21V 23/06* (2013.01)

USPC ..... 315/32; 313/493; 313/497; 313/317

(58) Field of Classification Search

USPC ..... 315/32, 238; 362/40

See application file for complete search history.

(56) References Cited

U.S. PATENT DOCUMENTS 4,082,395 A * 4/1978 Donato et al. ..... 439/115
4,578,731 A * 3/1986 Andriessen et al. ..... 361/42

(Continued)

FOREIGN PATENT DOCUMENTS

| | | | | |
|---|---|---|---|---|
| BE | 1006200 A3 | | 6/1994 | |
| CA | 1228638 | * | 10/1987 | ..... 317/8 |
| DE | 3811740 A1 | | 10/1989 | |
| DE | 9017421 U1 | | 4/1991 | |
| DE | 19628573 A1 | | 1/1998 | |
| EP | 0116505 A1 | | 8/1984 | |
| FR | 2613883 A1 | | 10/1988 | |
| FR | 2646736 A1 | | 11/1990 | |
| FR | 2836985 A1 | | 9/2003 | |
| GB | 2233837 A | * | 1/1991 | ..... H01R 25/14 |

OTHER PUBLICATIONS

Magic Lite Ltd: Company Product Manual, http://www.magiclite.com/dipline/dipline.pdf and http://www.magiclite.com/downloads/PDFs/dipine.pdf, 7 Page Document, May 15, 2010.

*Primary Examiner* — Douglas W Owens
*Assistant Examiner* — Srinivas Sathiraju
(74) *Attorney, Agent, or Firm* — Yuliya Mathis

(57) ABSTRACT

A system comprises a light source and an electrode device (20, 30, 60). The light source comprises a base (40) with a base surface (42) on which at least two contact elements are provided. The electrode device has at least two electrodes (23, 24, 34, 35), preferably of ferromagnetic or electromagnetic material and having a different polarity during operation. Adjacent electrodes are arranged at a predetermined electrode distance. Both electrodes are provided in one layer and are arranged in an interdigitated configuration. The light source has at least two, but preferably four contact elements (43, 53, 63) arranged at a mutual spacing which is essentially compatible with said electrode distance.

22 Claims, 6 Drawing Sheets

(56) References Cited

U.S. PATENT DOCUMENTS 5,559,681 A * 9/1996 Duarte ..... 362/231
D537,414 S * 2/2007 Saito ..... D13/146
8,390,184 B2 * 3/2013 Pet et al. ..... 313/317
2004/0128932 A1 7/2004 Estape
2011/0133642 A1 * 6/2011 Yang ..... 315/32

* cited by examiner

LIGHTING SYSTEM, ELECTRODE DEVICE AND LIGHT SOURCE

FIELD OF THE INVENTION

The invention relates to a system as defined in the pre-characterizing part of claim 1. The invention further relates to a light source and an electrode device, both being adapted for use in the system according to the invention.

BACKGROUND OF THE INVENTION

Such a system is marketed under the trade name of Dipline and described at the websites http://www.magiclite.com/dipline/diplilne.shtml and http://www.magiclite.com/downloads/PDFs/dipline.pdf. Dipline lit panel systems operate at low voltages, for example, 12 V or 24V. These systems are promoted as self-powered, flat, flexible panels which serve as an electrified wall or ceiling surface. It allows simple placement of light sources anywhere on a flat surface and has them light up instantly.

In the past few years, many relatively small light sources (=SLS), for example, LED products or miniature halogen lamps, have entered the market. Most of these products are retrofit so that they can be integrated in a current infrastructure with only limited investment. This, however, poses limitations on exploiting the full potential of SLS. Especially new buildings or homes provide the possibility of breaking away from the existing paradigms in lighting design. For example, it has already been proved that slim SLS lighting systems allow unobtrusive integration of lighting into a building. Apart from a different visual appearance of the lighting system, SLS-based systems also require new solutions for heat management, driver infrastructure, mechanical fixtures and user interfacing. One of the key value drivers of SLS integration in domestic environments is freedom of positioning. A consumer can create any desired lighting pattern by placing an SLS lighting system at any position on a wall or ceiling. Moreover, it is possible for a consumer to create his own atmosphere at home by combining several of these systems. In order that such a system works properly, it should allow easy positioning, fixation, and instant operation, and it should be robust. The known electrode device is a panel, and its electrodes are plate-shaped electrodes which are arranged in a stacked position. The plate electrodes are separated by a plate-shaped insulating layer, and each plate electrode is preferably covered by a decorative (and insulating) layer. The panels have typical dimensions of 1 square meter and a thickness of about 3 cm. The electrode device can be used to form façade walls or ceilings, or it can be alternatively applied as a cladding on existing walls, ceilings, or floors. The electrode device is connected to an electric energy supply system. The light sources, which are suitable for use in the known system, have pin-shaped electric contacts which are able to pierce the plate-shaped electrodes and the intermediate insulating layer. The pin-shaped electric contacts have different lengths so that, upon placing a light source on the electrode device, one electrode penetrates both plate electrodes and the other electrode penetrates only one plate electrode, thus realizing an appropriate electric contact with the electrode device. The pin-shaped electric contact penetrating both plate electrodes is partly coated with an insulating layer so as to prevent short-circuiting of the two plate electrodes via this electric contact. The system allows positioning of lamps at any desired location, thus offering great creative freedom of designing lumination and/or illumination patterns, and easy exchange to suitable and/or desired light sources in dependence upon the required application.

However, various problems are encountered with the known system, in particular:

difficulties in managing heat generated by the at least one light source during operation because of the electrically (and thermally) isolating layer between the electrodes;

due to switching the light source on and off, the electric contacts between the contact elements of the at least one light source and the electrodes will deteriorate and become unreliable as a result of the repeatedly thermal expansion and shrinkage of the contact elements of the at least one light source;

in current embodiments, users are limited to the use of pinboard-like walls if the visibility of the punched holes should diminish after removal of the at least one light source;

the known system is relatively inflexible and incapable of following relatively sharp contours of carrier materials (such as curved walls).

OBJECT AND SUMMARY OF THE INVENTION

It is an object of the invention to counteract at least one of the above-mentioned problems of the known prior-art system. To this end, the system as described in the opening paragraph is defined by the characterizing part of claim 1. In their interdigitated configuration, the electrodes are provided as a plurality of conducting strips which are arranged next to each other and have an alternating polarity when connected to a power supply and/or during operation of the system. The light source has at least two contact elements arranged at a mutual spacing which is essentially compatible with said electrode distance. Correct positioning of the light source on the electrode device is thus realized, without the need to frequently try to position the light source correctly. The feature of both electrodes being provided in one layer allows the electrode device to be relatively thin, for example, a few millimeters, for example, 5 mm or 3 mm or even 1 mm, and therefore allows the electrode device to be relatively flexible. Hence, the electrode device according to the invention can be appropriately provided on existing surfaces, for example, floors, walls and/or ceilings, having sharp contours. Moreover, if mechanical fixation is not required, for example, when the light source is to be positioned on a horizontal surface, for example, a floor or a table surface, the contact elements of the light source do not need to penetrate an electrode layer or layers and the insulating layer. The electric contacts can thus be optionally configured as having a blunt end surface which only rests on the electrode device and thus leaves no traces on the electrode device after removal of the light source. Alternatively, the electric contacts can be shaped as thin needles, thus leaving hardly any visible traces after removal of the light source from the electrode device. This is, for example, convenient when the electrode device is provided with a decorative screen so as to give it an aesthetic appearance. In this case, the electric contacts have to pierce the decorative screen only.

One embodiment of the system according to the invention is characterized in that the electrodes are made of ferromagnetic, ferrimagnetic or electromagnetic material, and in that the base is provided with at least one ferromagnetic, ferrimagnetic or electromagnetic adhesion device. The requirement imposed on the electric contacts of the lamp to be long and thick enough to fix the light source on the electrode device is thus no longer applicable: fixation of the light source on the electrode device is realized via magnetic adhesion instead. This allows exact positioning via small shifts and has the additional advantage that the various layers are not pierced so that no visibly disturbing traces are left after removal of the light source from the electrode device. A preferred system according to the invention is characterized in that the base comprises two couples of an electric contact and an adjacently positioned magnetic adhesion device, the two magnetic adhesion devices having a different polarity, and in that the electrodes of the electrode device are arranged in an interdigitated magnetic configuration. Mutual repulsion and/or attraction between the magnetic device of the lamp base and the magnetic device of the electrode device provides the advantage that, when mounting the light source on the electrode device, the light source and the electrode device automatically take up a mutually correct position.

In a further embodiment of the invention, the system is characterized in that the base is provided with four electric contacts which are mutually positioned in such a way that, generally at a random position of the light source on the electrode device, at least one pair of electric contacts is electrically connected to a pair of adjacent electrodes having a different polarity, and in that the contact elements are electrically connected to each other in accordance with the scheme shown in FIG. 5B. Such an embodiment has the advantage that it increases the chance of correctly positioning the light source on the electrode device as compared to a light source having three contact elements. A further embodiment of the system, which increases the chance of correctly positioning the light source up to, for example, 95%, is characterized in that three of the four contact elements are mutually arranged in such a way that they form an equilateral triangle, and in that a remaining fourth contact element is provided in the center point of said triangle.

A preferred embodiment of the system according to the invention is characterized in that the mutual dimensions of the electrodes, contact elements, spacings between electrodes, and distances between contact elements are provided in the system in the ranges defined by the following equations:

$$R/P<(1-q/P), \text{ and}$$

$$(1+q/P)<1.5*R/P, \text{ in which}$$

R is the distance between the center of the equilateral triangle and its corners;

P (pitch) is the sum of the width of one electrode and one spacing with width f*P between two electrodes; and q is the duty cycle q=f*P.

Such a system allows the light source to be always correctly positioned at any position on the electrode device, i.e. at least one pair of electric contacts is electrically connected to a pair of adjacent electrodes of different polarity in any position of the light source on the electrode device. As a result, the user-friendliness of the system is further improved. Alternatively, this result is obtained for a system which is characterized in that there are five or more contact elements, whose contacts are mutually positioned in such a way that, generally at a random position of the light source on the electrode device, at least one pair of electric contacts is electrically connected to a pair of adjacent electrodes having a different polarity, and in that the contact elements are electrically connected to each other in accordance with the scheme shown in FIG. 5B.

The invention further relates to a light source having all light source characteristics of the system as defined in any one of claims 1 to 9 and to an electrode device having all electrode device characteristics of the system as defined in any one of claims 1 to 9.

BRIEF DESCRIPTION OF THE DRAWINGS

The invention will now be elucidated with reference to the drawings, in which.

DESCRIPTION OF EMBODIMENTS

Figure 1:
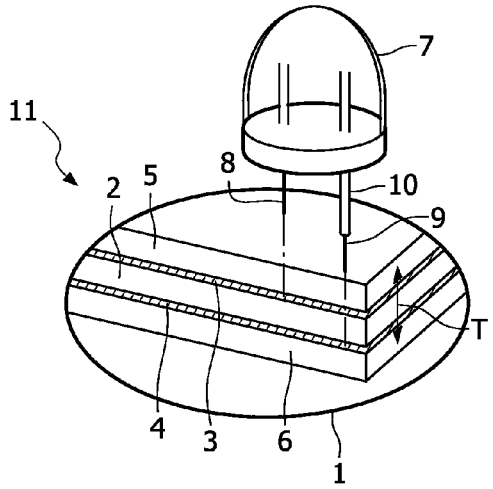
FIG. 1 PRIOR ART
FIG. 1 shows the system according to the prior art.

In the known prior-art system 11 shown in FIG. 1, the electrode device 1 is an insulated plate 2 having both its main surfaces covered with thin metal foils which constitute a first electrode 3 and a second electrode 4. For mechanical and, optionally, aesthetic reasons, each electrode is covered with a respective screen 5, 6. The known electrode device typically has a thickness T of about 20 mm and the insulating plate and screens are typically made of foam material. A light source 7 is mechanically mountable onto the electrode device 1 via a first electric contact 8 and a second electric contact 9. The first electric contact 8 is relatively short so that it cannot reach the second electrode 4 but can only pierce it and thus establish an electric connection with the first electrode 3. The second electric contact 9 is relatively long and can thus pierce both electrodes 3 and 4, thus establishing an electric connection with the second electrode. To avoid electric connection with the first electrode, the second electric contact is partly provided with an insulating layer 10.

Figure 2:
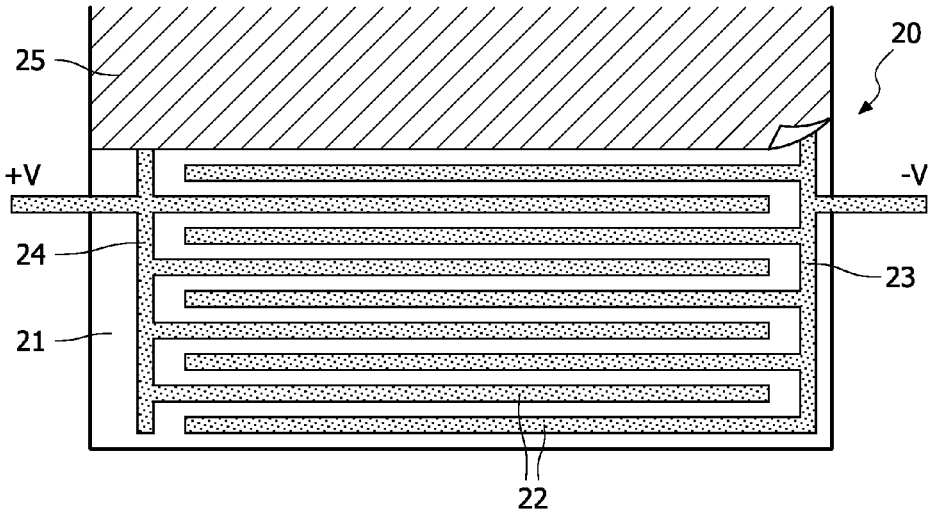
FIG. 2 shows the structure of a first embodiment of the electrode device according to the invention.

FIG. 2 is a top view of a first embodiment of the electrode device 20 according to the invention. The electrode device comprises a flexible board 21, for example, a printed circuit board, on or in which ferromagnetic strips 22 have been provided. All strips extend in one direction, are placed equidistantly, and are provided essentially in one layer, yielding an electrode device with a thickness of about 2 mm. The strips are electrically connected in such a way that they constitute an interdigitated configuration, i.e. two comb structures having a different electric and permanent magnetic polarity. The first comb 23 is connected to the minus electrode of a power supply and the second comb 24 is connected to the plus electrode of the power supply. The voltage is preferably below 50V, for example, 24V, and DC, but this may be alternatively AC. To avoid visibility of this electric structure to a consumer, the electrode device is optionally covered with a thin foil 25 which is not electrically conductive. This foil may be a decorative element, for example, for in-home applications, but it may also function as a primer layer for normal ceiling or wall covering, such as (latex) paint, plaster or wall paper. If there is no cover foil, the electrodes are to be preferably provided with a non-corrosive (stack of) material so as to protect the strips from corrosion. This material may be a conductive material.

Figure 3:
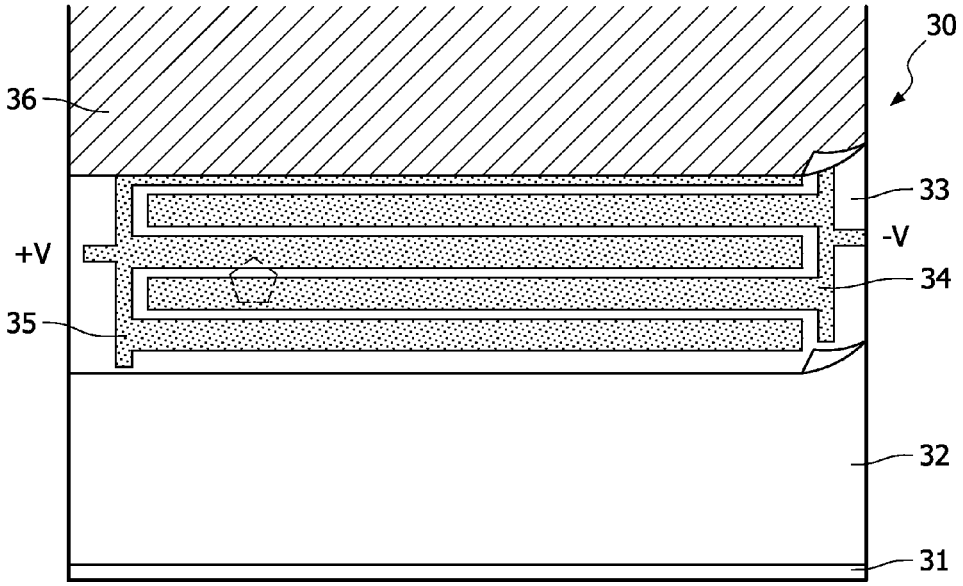
FIG. 3 shows the structure of a second embodiment of the electrode device according to the invention.

FIG. 3 shows a second embodiment of the electrode device according to the invention, in which the electrode functionality and ferromagnetic or electromagnetic functionality of the interdigitated electrode configuration of FIG. 2 are separated. The electrode device 30 of the embodiment shown in FIG. 3 comprises a substrate 31 on which a ferromagnetic or electromagnetic layer 32 is provided. This layer may be embodied as one, closed layer or as a patterned structure, for example, a stripe or a block pattern. A printed circuit board 33 (=PCB) with an interdigitated electrode configuration 34, 35 is provided on top of the substrate and its magnetic layer. A protective and/or aesthetic screen 36 is provided on top of the substrate, the magnetic layer and the PCB. A light source (not shown) can be connected to the electrode device via a lamp base (see FIGS. 4A and 4B). In FIG. 3, an equilateral pentangle, i.e. a light source having five electric contacts, schematically represents a mounted light source. Each corner of the pentangle represents an electric contact of the light source. The light source may be a miniature halogen lamp, for example, one or more halogen lamps each having a nominal power of 20 W during operation, or it may be a LED or a plurality of LEDs each having a nominal power of about 3 W.

Figure 4A:
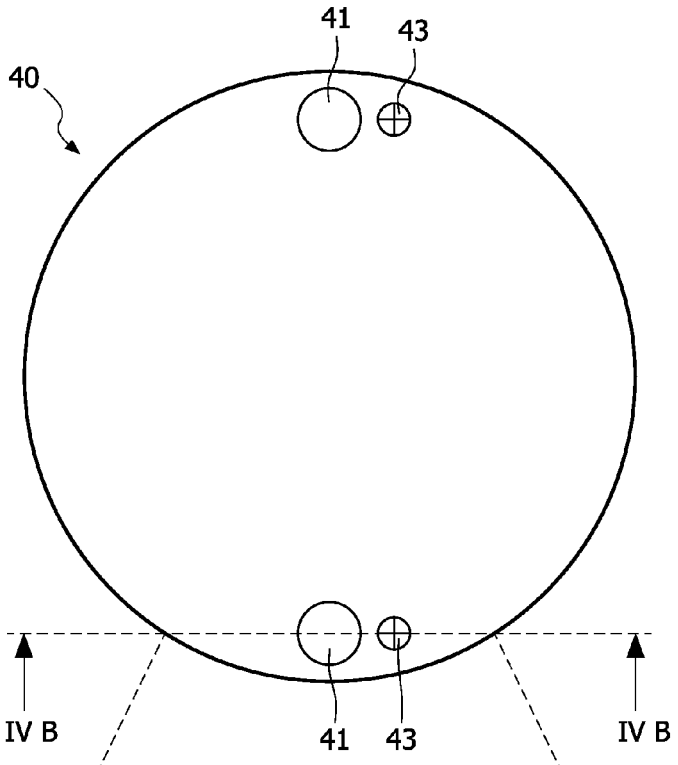
FIG. 4A is an elevational view of a first embodiment of the base of a light source according to the invention.
Figure 4B:
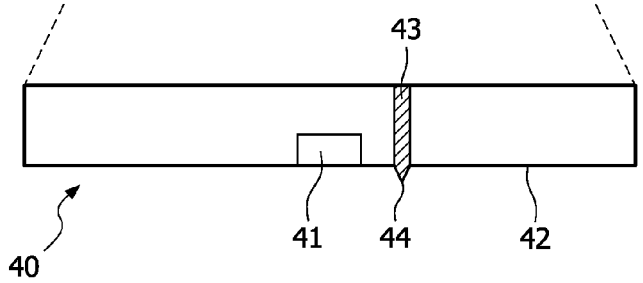
FIG. 4B is a cross section of a first embodiment of the base of a light source as shown in FIG. 4A.

FIG. 4A is an elevational view of a first embodiment of a lamp base 40 of a light source according to the invention, and FIG. 4B is a cross-sectional view along IVB-IVB of the lamp base 40 of said light source shown in FIG. 4A. The base comprises at least two magnets 41 positioned at a distance which is equal to the pitch of the strips (see FIG. 2 and FIG. 3). In FIG. 4A, the two magnets have a different polarity so as to allow automatic, correct positioning of the light source on the electrode device shown in FIG. 2. The magnets are also placed flush with the bottom 42 of the lamp base. Although the strips are made invisible to the consumer, the magnets will sense the strips and align with them. Once mechanically connected, the lamp base will be stuck and held by magnetic force. Additional elements of the lamp base are at least two electric contacts 43 placed adjacent to or at a close distance from the magnets. Each electrode has a sharp, pin-shaped end 44 and extends through a small distance from the bottom of the mounting stage and can pierce the thin layer of paint, fabric or paper screen (by means of the magnetic force). The electric connection between the electrode device and the light source is established in this way. Upon removal of the holder, punctures made by the electric connectors are so small that they are hardly visible on the wall.

Figure 5A:
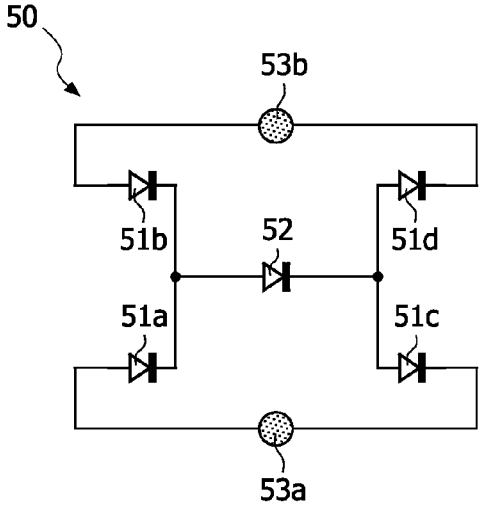
FIG. 5A is a circuit arrangement of the electric contacts of a light source having two electric contacts.

In the case of a two-electrode system (see FIG. 4A), the simplest connection scheme is just connecting the electric contacts to the light source. However, for a DC-system, this connection scheme can connect the voltage in two directions. This is no problem if the light source is a miniature halogen lamp. However, if the light source is a LED, the problem arises that the connection may be reverse to the LEDs and the LED will fail to work. This problem is solved by using the connection scheme 50 as shown in FIG. 5A, comprising diodes 51*a*, 51*b*, 51*c*, 51*d*, and the lamp base of the LED 52 can be placed with its with positive voltage on the upper electrode and with its negative voltage on the lower electrode, or vice versa. In FIG. 5A the LED 52 is connected with its anode to the cathode of the diodes 51*a* and 51*b*, and the LED 52 is connected with its cathode to the anode of the diodes 51*c* and 51*d*. The anode of diode 51*a* and the cathode of diode 51*c* are connected to a common first input terminal 53*a*, and the anode of diode 51*b* and the cathode of diode 51*d* are connected to a common second input terminal 53*b*.

Figure 5B:
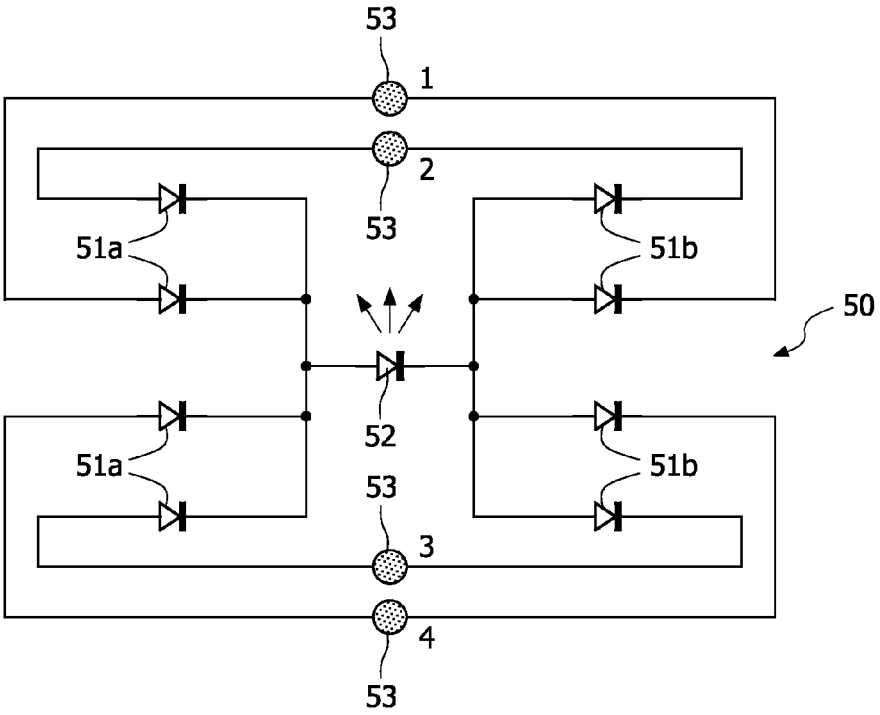
FIG. 5B is a circuit arrangement of the electric contacts of a light source having four electric contacts.

The proposed configuration of only two electric contacts poses the problem that the light source will fail to operate. If both electric contacts are aligned on a single electrode strip, there will be no voltage difference to drive the light source which will then not operate. This problem is counteracted by choosing a light source having a lamp base with four electrodes, for example, arranged in a square configuration or in a centered equilateral triangle configuration. In a system with four electric contacts, the connection scheme 50 shown in FIG. 5B should be used. It shows a number of first diodes 51*a*, and a same number of second diodes 51*b* and the light source 52 with a same number of electric contacts 53, in FIG. 5B said number is four. The LED 52 is connected with its anode to the cathodes of the first number of diodes 51*a*, and the LED 52 is connected with its cathode to the anodes of the second number of diodes 51*b*. Each anode of a respective diode of the first number of diodes 51*a* is connected via a respective electrical contact/input terminal 53 to the cathode of a respective diode of the second number of diodes 51*b*. In this way, the LED will be driven irrespective of the orientation of the holder. On the basis of the connection scheme for four electric contacts shown in FIG. 5B, it will be easy for those skilled in the art to design a connection scheme for five or six electric contacts.

Figure 6:
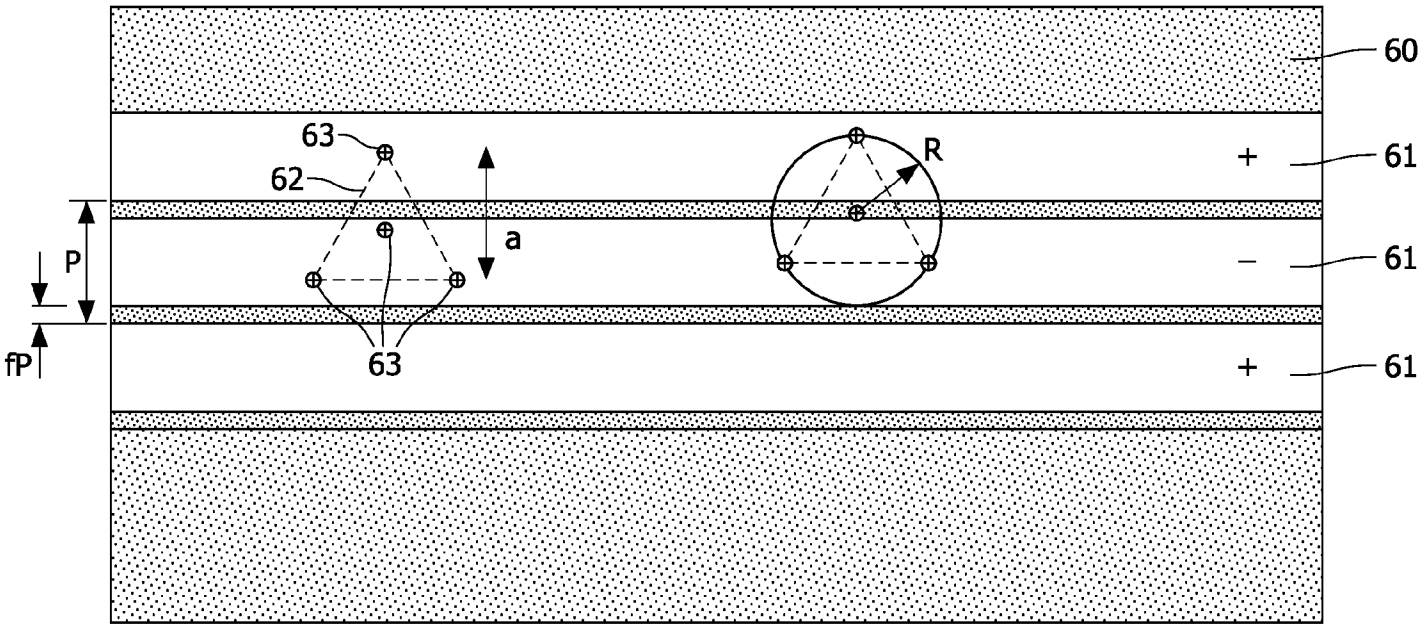
FIG. 6 shows the dimensional relationship between the electrodes of the electrode device and the electric contacts of the light source.

If the configuration of four electric contacts of a light source does not match with the dimensions of the electrode device, there may not be a correct position of the electric connection between the light source and the electrode device. To counteract this possibility and thus to ensure that a correct position is always obtained and the light source will always operate, FIG. 6 shows a top view of the dimensional parameters by which the dimensional relationship between the electrodes 61 of the electrode device 60 and the electric contacts 63 of the light source 62 is described. The electric contacts of the light source are arranged in the corners and center of an equilateral triangle having a height a, the electric contact in the center being spaced from the electric contacts in the corners by a distance R (one can envisage that all of the three electric contacts in the corners are equidistantly positioned on a circle having a radius R, with the central electric contact in the center of said circle). The electrode strips 61 of the electrode device 60 are arranged at a pitch P with a mutual spacing f*P between two adjacent electrode strips. The following equations can be derived from the condition that at least two electric contacts are always situated on strips of a different polarity:

$$f \cdot P < \frac{1}{3} \cdot a < P \tag{1}$$

$$\frac{q}{P} < \frac{1}{2} \cdot \frac{R}{P} < 1$$

$$P < a < 2 \cdot P - f \cdot P \tag{2}$$

Use other parameters:

Radius $R = \frac{2}{3a}$ and duty cycle $q = f * P$ $$1 < \frac{3R}{2P} < 2 - \frac{q}{p}$$

$$\frac{2}{3} \cdot a < (1 - f) \cdot P \tag{3}$$

$$\frac{R}{P} < \left(1 - \frac{q}{p}\right)$$

-continued $$(1+f)\cdot P < a \quad (4)$$

$$\left(1+\frac{q}{P}\right) < \frac{3R}{2P}$$

Figure 7:
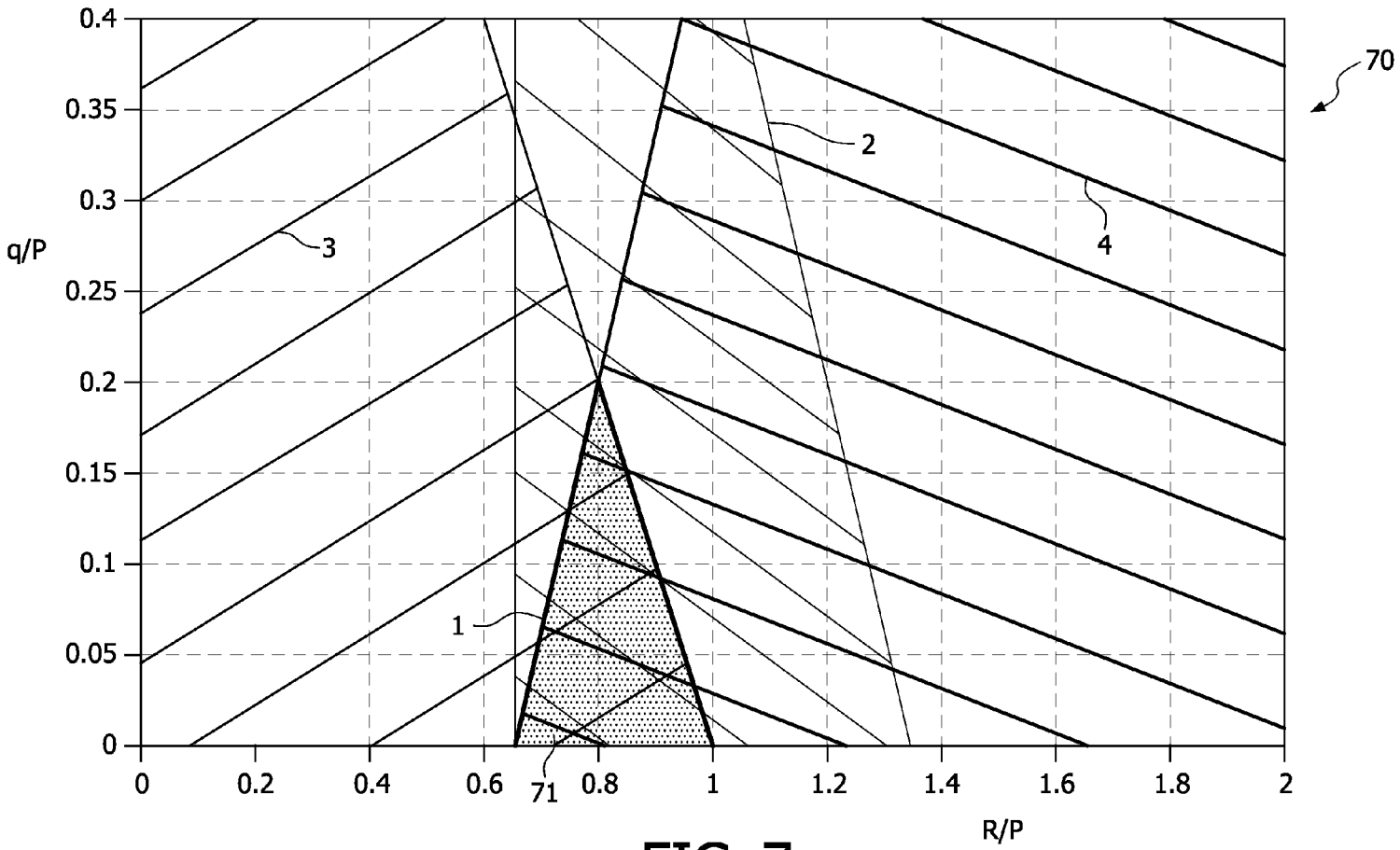
FIG. 7 is a graph indicating the regime of the dimensional relationship between the electrodes of the electrode device and the electric contacts of the light source as shown in FIG. 6.

A graph 70 can be made by means of equations (1) to (4), with the appropriate range plotted for each equation (1) to (4). All of the four equations are satisfied when using the regime for the dimensional relationship between the electrodes of the electrode device and the electric contacts of the light source as shown in FIG. 6, for which always a correct position of the light source on the electrode device is obtained. This regime is indicated by the shaded area 71 in FIG. 7. It is apparent from this graph that the regime is determined by equations (3) and (4), while the spacing f*P is maximally 0.2*P and the allowed radius R is in the range of 0.67*P<R<P.

The invention claimed is:

1. A system comprising an electrode device and a light source for emitting light;

the light source comprising a base with a base surface on which at least four contact elements are provided; and the electrode device having at least two electrodes which have a different polarity during operation, with adjacent electrodes being arranged at a predetermined electrode distance with respect to each other, wherein said electrodes are provided in a single layer and are arranged in an interdigitated configuration, wherein the light source comprises at least two contact elements arranged at a mutual spacing, said mutual spacing compatible with said electrode distance.

2. A system as claimed in claim 1, wherein the base comprises two couples of an electric contact and an adjacently positioned magnetic adhesion device, the two magnetic adhesion devices having a different polarity, and in that the electrodes of the electrode device are arranged in an interdigitated magnetic configuration.

3. A system as claimed in claim 1, wherein a surface of the electrode device facing the light source is provided with a screen.

4. A system as claimed in claim 3, wherein each electric contact has a needle-shaped end for piercing the screen.

5. A system as claimed in claim 1, wherein the base is provided with electric contacts which are mutually positioned at a random position of the light source on the electrode device, at least one pair of electric contacts is electrically connected to a pair of adjacent electrodes having a different polarity, and in that the light source is connected with its anode to the cathodes of a first number of diodes, and the light source is connected with its cathode to the anodes of a same number of second diodes, each anode of a respective diode of the number of first diodes is connected via a respective of the same number of electrical contact/input terminals to the cathode of a respective diode of the number of second diodes, said number being chosen from the range 3 to 8.

6. A system as claimed in claim 5, wherein three of the four contact elements are mutually arranged in such a way that they form an equilateral triangle, and in that a remaining fourth contact element is provided in the center point of said triangle.

7. A system as claimed in claim 6, wherein the mutual dimensions of the electrodes, contact elements, spacings between electrodes, and distances between contact elements are provided in the system in the ranges defined by the following equations:

$$R/P<(1-q/P), \text{ and}$$

$$(1+q/P)<1.5*R/P, \text{ in which}$$

R is the distance between the center of the equilateral triangle and its corners;

P (pitch) is the sum of the width of one electrode and one spacing with width f*P between two electrodes; and q is the duty cycle q=f*P.

8. A system as claimed in claim 5, wherein the number is four.

9. A light source comprising a base having a base surface on which at least four contact elements are provided and arranged at a mutual spacing which is spaced with respect to one another to be compatible with at least two electrodes of an electrode device, at least two electrodes of said electrode device being arranged at a predetermined electrode distance and having a different polarity during operation, wherein the at least two electrodes are provided in one layer and are arranged in an interdigitated configuration.

10. An electrode device having at least two electrodes which have a different polarity during operation, with adjacent of said at least two electrodes being arranged at a predetermined electrode distance, wherein the electrodes are provided in a single layer and are arranged in an interdigitated configuration, the interdigitated configuration and predetermined electrode distance being compatible with a light source comprising a base having at least four contact elements are provided, at least two contact elements arranged at a mutual spacing with said predetermined electrode distance.

11. A system comprising an electrode device and a light source for emitting light:

the light source comprising a base with a base surface on which at least four contact elements are provided; and the electrode device having at least two electrodes which have a different polarity during operation, with adjacent electrodes being arranged at a predetermined electrode distance, wherein the electrodes are provided in one layer and are arranged in an interdigitated configuration, wherein and in that the light source comprises at least four contact elements arranged at a mutual spacing which is compatible with said electrode distance.

12. A system as claimed in claim 11, wherein the base comprises two couples of an electric contact and an adjacently positioned magnetic adhesion device, the two magnetic adhesion devices having a different polarity, and in that the electrodes of the electrode device are arranged in an interdigitated magnetic configuration.

13. A system as claimed in claim 11, wherein a surface of the electrode device facing the light source is provided with a screen.

14. A system as claimed in claim 13, wherein each electric contact has a needle-shaped end for piercing the screen.

15. A system as claimed in claim 11, wherein the base is provided with electric contacts which are mutually positioned at a random position of the light source on the electrode device, at least one pair of electric contacts is electrically connected to a pair of adjacent electrodes having a different polarity, and in that the light source is connected with its anode to the cathodes of a first number of diodes, and the light source is connected with its cathode to the anodes of a same number of second diodes, each anode of a respective diode of the number of first diodes is connected via a respective of the same number of electrical contact/input terminals to the cathode of a respective diode of the number of second diodes, said number being chosen from the range 4 to 8.

16. A system as claimed in claim 15, wherein three of the four contact elements are mutually arranged in such a way that they form an equilateral triangle, and in that a remaining fourth contact element is provided in the center point of said triangle.

17. A system as claimed in claim 16, wherein the mutual dimensions of the electrodes, contact elements, spacings between electrodes, and distances between contact elements are provided in the system in the ranges defined by the following equations:

$$R/P<(1-q/P), \text{ and}$$

$$(1+q/P)<1.5*R/P, \text{ in which}$$

R is the distance between the center of the equilateral triangle and its corners;

P (pitch) is the sum of the width of one electrode and one spacing with width f*P between two electrodes; and q is the duty cycle q=f*P.

18. A system as claimed in claim 15, wherein the number is four.

19. A light source comprising a base having a base surface on which at least four contact elements are provided and are spaced with respect to one another to be compatible with at least two electrodes of an electrode device, the at least two electrodes being arranged at a predetermined electrode distance and having a different polarity during operation, wherein the at least two electrodes are provided in one layer and are arranged in an interdigitated configuration.

20. An electrode device having at least two electrodes which have a different polarity during operation, with adjacent of said at least two electrodes being arranged at a predetermined electrode distance, wherein the electrodes are provided in one layer and are arranged in an interdigitated configuration, the interdigitated configuration and predetermined electrode distance being compatible with a light source comprising a base with a base surface on which at least four contact elements are provided, the at least four contact elements arranged at a mutual spacing with said predetermined electrode distance.

21. A system as claimed in claim 1, wherein the electrodes are made of ferromagnetic, ferrimagnetic or electromagnetic material, and in that the base is provided with at least one ferromagnetic, ferrimagnetic or electromagnetic adhesion device.

22. A system as claimed in claim 11, wherein the electrodes are made of ferromagnetic, ferrimagnetic or electromagnetic material, and in that the base is provided with at least one ferromagnetic, ferrimagnetic or electromagnetic adhesion device.

* * * * *